US010107175B1

(12) United States Patent
Bowler et al.

(10) Patent No.: US 10,107,175 B1
(45) Date of Patent: Oct. 23, 2018

(54) VALVE ASSEMBLY FOR THERMAL MANAGEMENT SYSTEM

(71) Applicant: GM GLOBAL TECHNOLOGY OPERATIONS LLC, Detroit, MI (US)

(72) Inventors: Alan E. Bowler, Fenton, MI (US); Michael Kaczmar, Farmington Hills, MI (US)

(73) Assignee: GM Global Technology Operations LLC, Detroit, MI (US)

( * ) Notice: Subject to any disclaimer, the term of this patent is extended or adjusted under 35 U.S.C. 154(b) by 0 days.

(21) Appl. No.: 15/647,942

(22) Filed: Jul. 12, 2017

(51) Int. Cl.
*F01P 7/14* (2006.01)
*F01K 27/00* (2006.01)
*F01P 3/20* (2006.01)

(52) U.S. Cl.
CPC ..... *F01P 7/14* (2013.01); *F01P 3/20* (2013.01); *F01P 2007/146* (2013.01)

(58) Field of Classification Search
CPC ... F01P 2007/146; F01P 3/00; F16K 99/0011; F16K 99/0013; F16K 99/0028; F16K 31/041; F16K 11/07; F16K 11/22; F16K 27/003; F16K 31/04; F16K 31/523; F16K 31/53; F16K 31/535
See application file for complete search history.

(56) References Cited

U.S. PATENT DOCUMENTS

2003/0127528 A1* 7/2003 Sabhapathy ..... B60H 1/04 237/12.3 B
2005/0034688 A1* 2/2005 Lelkes ..... F01P 7/167 123/41.01
2010/0212612 A1* 8/2010 Vacca ..... F01P 7/165 123/41.09
2013/0305708 A1 11/2013 Zahdeh et al.
2015/0101693 A1* 4/2015 Enomoto ..... F16K 11/22 137/597
2015/0354714 A1 12/2015 Morein
2015/0354716 A1 12/2015 Morein
2016/0040585 A1 2/2016 Schaefer
2016/0363036 A1* 12/2016 Imasaka ..... F01P 7/16
2016/0376977 A1* 12/2016 Watanabe ..... F01P 5/12 123/41.08
2017/0108141 A1 4/2017 Miller, III et al.
2017/0138248 A1* 5/2017 Lee ..... F01P 7/165

* cited by examiner

*Primary Examiner* — Long T Tran
(74) *Attorney, Agent, or Firm* — Quinn IP Law

(57) ABSTRACT

A fluidic valve assembly is disposed in a thermal management system for an internal combustion engine, and includes a unitary housing including a first rotary valve, a second rotary valve and a third rotary valve. The first, second and third rotary valves include a respective first, second and third rotatable valve body that is coupled to a respective first, second and third actuator. The first, second and third rotary valves are disposed to regulate fluidic flow between heat exchange elements of the thermal management system. The second and third rotary valves are coaxially disposed about a first axis of rotation and the first rotary valve is coaxially disposed about a second axis of rotation, with the first axis of rotation being non-parallel to the second axis of rotation.

12 Claims, 4 Drawing Sheets

VALVE ASSEMBLY FOR THERMAL MANAGEMENT SYSTEM

INTRODUCTION

Thermal management systems for powertrain systems circulate coolant to transfer heat to promote warmup of the coolant after an engine cold start and promote heat transfer and cooling during operation.

SUMMARY

A fluidic valve assembly is disposed in a thermal management system for an internal combustion engine, and includes a unitary housing including a first rotary valve, a second rotary valve and a third rotary valve. The first, second and third rotary valves include a respective first, second and third rotatable valve body that is coupled to a respective first, second and third actuator. The first, second and third rotary valves are disposed to regulate fluidic flow between heat exchange elements of the thermal management system. The second and third rotary valves are coaxially disposed about a first axis of rotation and the first rotary valve is coaxially disposed about a second axis of rotation, with the first axis of rotation being non-parallel to the second axis of rotation.

An aspect of the disclosure includes the first axis of rotation being orthogonal to the second axis of rotation.

Another aspect of the disclosure includes the thermal management system including a fluidic circuit composed of a plurality of heat exchange elements and a fluidic pumping element.

Another aspect of the disclosure includes the first, second and third rotatable valve bodies having disc-shaped devices that are disposed within a respective annular portion of the unitary housing.

A fluidic valve assembly is configured to direct fluidic flow in a thermal management system of a powertrain system. The thermal management system includes a fluid jacket for an engine block, a fluid jacket for a cylinder head, a cabin heater core, a fluid jacket for an exhaust manifold, a transmission fluid heat exchanger, an engine oil heat exchanger, a radiator and a fluidic pumping element. The fluidic valve assembly includes a first rotary valve, a second rotary valve and a third rotary valve that are disposed in a housing. Each of the first, second and third rotary valves includes a rotatable valve body that is disposed within an annular portion of the housing and coupled to an actuator. The rotatable valve body of the first rotary valve includes a first valve element that is controllably disposed to regulate coolant flow to the transmission fluid heat exchanger and a second valve element that is controllably disposed to regulate coolant flow to the engine oil heat exchanger. The rotatable valve body of the second rotary valve includes a third valve element that is controllably disposed to regulate coolant flow from the fluid jacket for the engine block, and a fourth valve element that is controllably disposed to regulate coolant flow from the fluid jacket for the cylinder head. The rotatable valve body of the third rotary valve includes a fifth valve element that is controllably disposed to regulate coolant flow from the second rotary valve and the fluid jacket for the exhaust manifold to the cabin heater core and a sixth valve element that is controllably disposed to regulate coolant flow from the second rotary valve and the fluid jacket for the exhaust manifold to the radiator. The first and second valve elements of the first rotary valve are coaxial about a first axis of rotation, and the third and fourth valve elements of the second rotary valve are coaxial about a second axis of rotation. The first axis of rotation is non-parallel to the second axis of rotation.

Another aspect of the disclosure includes the rotatable valve body of the first rotary valve including a first valve element that is controllably disposed to regulate coolant flow from the fluid jacket for the engine block to the transmission fluid heat exchanger.

Another aspect of the disclosure includes the rotatable valve body of the first rotary valve including a first valve element that is controllably disposed to regulate coolant flow from the fluid jacket for the engine block to the engine oil heat exchanger.

Another aspect of the disclosure includes the rotatable valve body of the first rotary valve including a first valve element that is controllably disposed to regulate coolant flow from the radiator to the transmission fluid heat exchanger.

Another aspect of the disclosure includes the rotatable valve body of the first rotary valve including a first valve element that is controllably disposed to regulate coolant flow from the radiator to the engine oil heat exchanger.

The above features and advantages, and other features and advantages, of the present teachings are readily apparent from the following detailed description of some of the best modes and other embodiments for carrying out the present teachings, as defined in the appended claims, when taken in connection with the accompanying drawings.

BRIEF DESCRIPTION OF THE DRAWINGS

One or more embodiments will now be described, by way of example, with reference to the accompanying drawings, in which.

It should be understood that the appended drawings are not necessarily to scale, and present a somewhat simplified representation of various preferred features of the present disclosure as disclosed herein, including, for example, specific dimensions, orientations, locations, and shapes. Details associated with such features will be determined in part by the particular intended application and use environment.

DETAILED DESCRIPTION

The components of the disclosed embodiments, as described and illustrated herein, may be arranged and designed in a variety of different configurations. Thus, the following detailed description is not intended to limit the scope of the disclosure, as claimed, but is merely representative of possible embodiments thereof. In addition, while numerous specific details are set forth in the following description in order to provide a thorough understanding of the embodiments disclosed herein, some embodiments can be practiced without some of these details. Moreover, for the purpose of clarity, certain technical material that is understood in the related art has not been described in detail in order to avoid unnecessarily obscuring the disclosure. Furthermore, the drawings are in simplified form and are not to precise scale. For purposes of convenience and clarity, directional terms such as top, bottom, left, right, up, over, above, below, beneath, rear, and front, may be used with respect to the drawings. These and similar directional terms are not to be construed to limit the scope of the disclosure. Furthermore, the disclosure, as illustrated and described herein, may be practiced in the absence of an element that is not specifically disclosed herein. As employed herein, the term "upstream" and related terms refer to elements that are towards an origination of a flow stream relative to an indicated location, and the term "downstream" and related terms refer to elements that are away from an origination of a flow stream relative to an indicated location.

Figure 1:
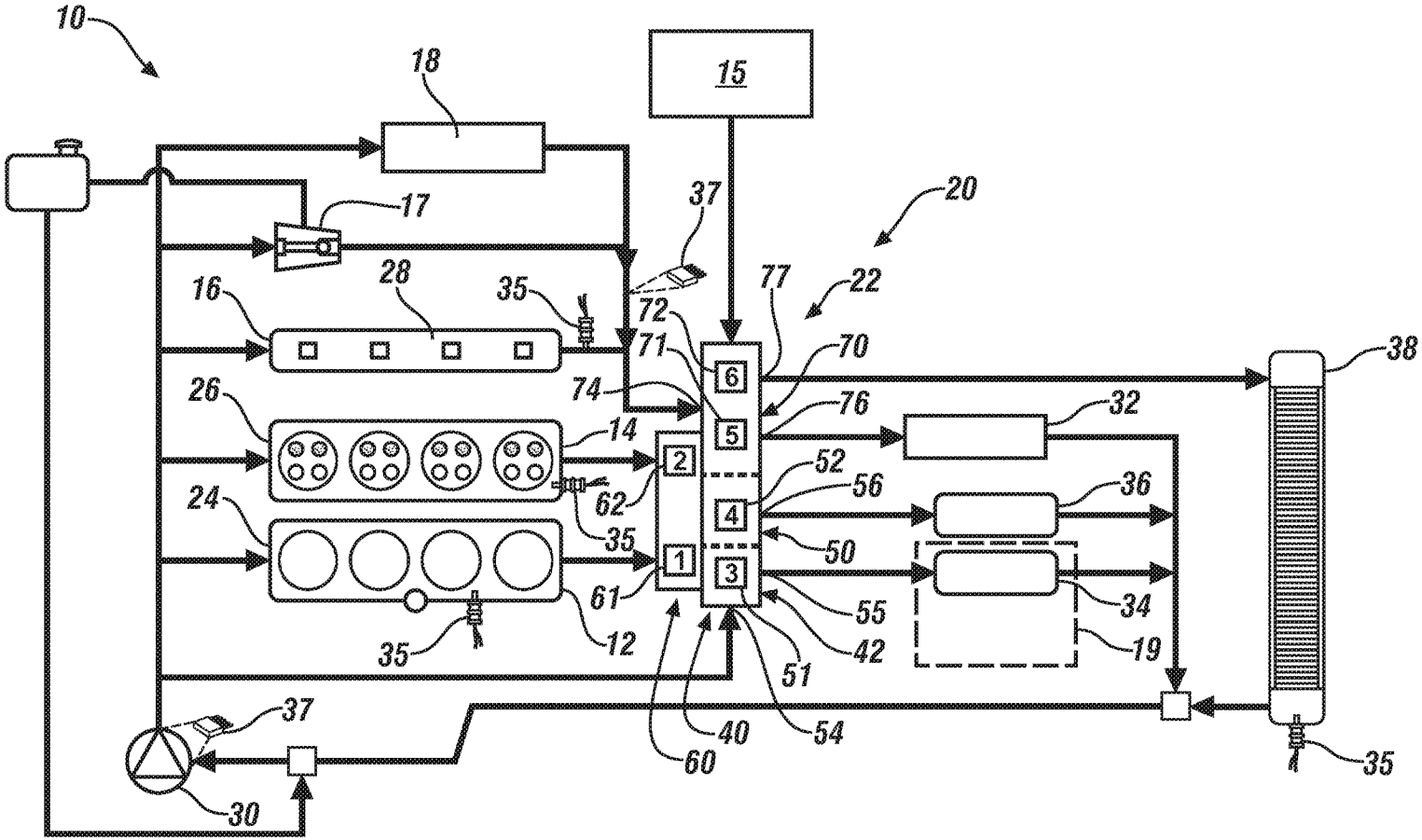
FIG. 1 schematically shows a thermal management system for a powertrain system composed of an internal combustion engine and a transmission, in accordance with the disclosure.

Referring to the drawings, wherein like reference numerals correspond to like or similar components throughout the several Figures, FIG. 1, consistent with embodiments disclosed herein, illustrates a thermal management system 20 for a powertrain system including an internal combustion engine (engine) 10 and transmission 19 that may be disposed in a vehicle. The vehicle may include, but not be limited to a mobile platform in the form of a commercial vehicle, industrial vehicle, agricultural vehicle, passenger vehicle, aircraft, watercraft, train, all-terrain vehicle, personal movement apparatus, robot and the like to accomplish the purposes of this disclosure.

The engine 10 may be any internal combustion engine configuration, including, e.g., a spark-ignition configuration or a combustion-ignition configuration. The engine 10 includes an engine block 12, one (or a more) cylinder head 14, and an integrated exhaust manifold 16. Other elements may include, in one embodiment, a turbocharger 17 and a cooled EGR system 18.

The thermal management system 20 is advantageously configured to transfer heat in the engine 10 and transmission 19, including removing combustion heat from the engine 10 and transferring heat of combustion from the engine 10 to areas that may benefit from additional heat. The thermal management system 20 includes a closed fluidic circuit 22 that is composed of a fluidic pump 30, a fluidic valve assembly 40, and a plurality of heat exchange elements in the form of heat sources and heat sinks that are fluidly coupled via conduits. The fluidic valve assembly 40 includes first, second and third rotary valves 50, 60, and 70 that are disposed to regulate fluidic flow between the heat sources and the heat sinks. The heat sources include, by way of non-limiting examples, an engine block fluid jacket 24, a cylinder head fluid jacket 26, an exhaust manifold fluid jacket 28. The heat sinks include, by way of non-limiting examples, a cabin heater core 32, a transmission fluid heat exchanger 34, an engine oil heat exchanger 36 and a fluid/air radiator 38. The thermal management system also includes one or multiple temperature sensors 35 and one or multiple pressure sensors 37 that are disposed to monitor parameters associated various elements of the thermal management system 20 and the closed fluidic circuit 22, including, by way on non-limiting examples, an engine inlet coolant temperature, an engine outlet coolant temperature, a cylinder head temperature, an engine block temperature, a radiator temperature, etc.

The fluidic pump 30 can be an electrically-powered fluidic pumping device having a speed and flowrate that is controllable independently from operation of the engine 10. Alternatively, the fluidic pump 30 may be a mechanically-powered device that is driven by the engine 10. The fluidic pump 30 includes, in one embodiment, an outlet that is fluidly coupled in parallel to the heat sources, i.e., the engine block fluid jacket 24, the cylinder head fluid jacket 26, the exhaust manifold fluid jacket 28, and an inlet to a first rotary valve 50 of the fluidic valve assembly 40. The illustrated arrangement of the elements of the thermal management system 20 is non-limiting, and other configurations of the thermal management system 20 are envisioned within the scope of the disclosure.

A controller 15 is configured to monitor parameters from the temperature sensors 35, the pressure sensors 37, and engine and transmission operating parameters and control operation of the fluidic pump 30 and the fluidic valve assembly 40 to regulate fluidic flow to the heat sources and heat sinks of the thermal management system 20 based thereon. Regulating the fluidic flow includes being capable of permitting a maximum flowrate, or partially or completely restricting the fluidic flowrate, and thus selectively distribute the fluidic flow to effect heat transfer. The controller 15 is configured to control operation of the fluidic pump 30 and actuators that control the first, second and third rotary valves 50, 60, and 70 of the fluidic valve assembly 40 to regulate fluidic flow through the various elements of the thermal management system 20 to manage heat transfers during powertrain events that can include engine cold start, warmup, steady-state and other operations. The term "controller" and related terms refer to one or various combinations of Application Specific Integrated Circuit(s) (ASIC), electronic circuit(s), central processing unit(s), e.g., microprocessor(s) and associated non-transitory memory component(s) in the form of memory and storage devices (read only, programmable read only, random access, hard drive, etc.).

Figure 2:
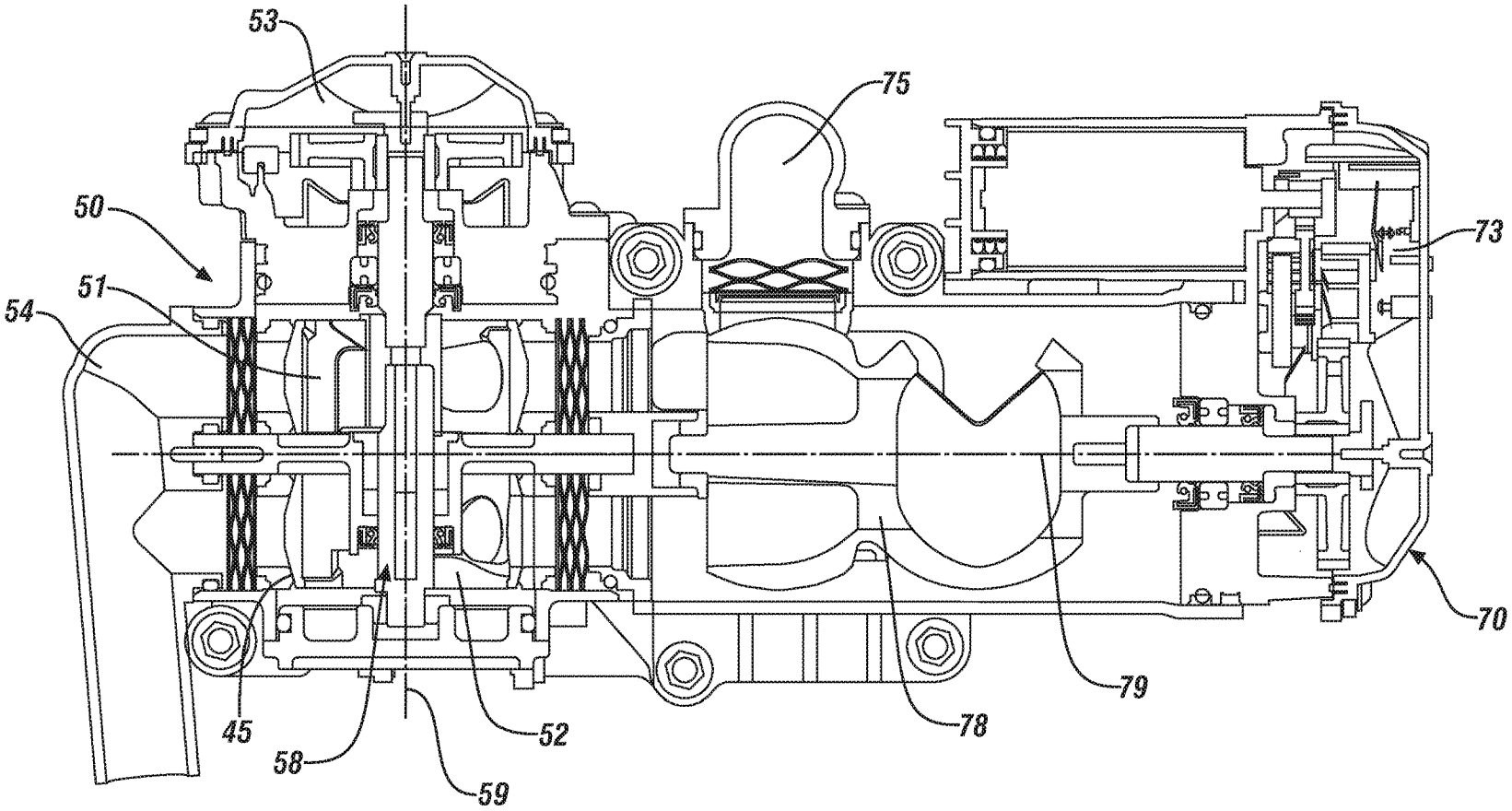
FIG. 2 is a sectioned right-side view of an embodiment of a fluidic valve assembly of the thermal management system, in accordance with the disclosure.
Figure 3:
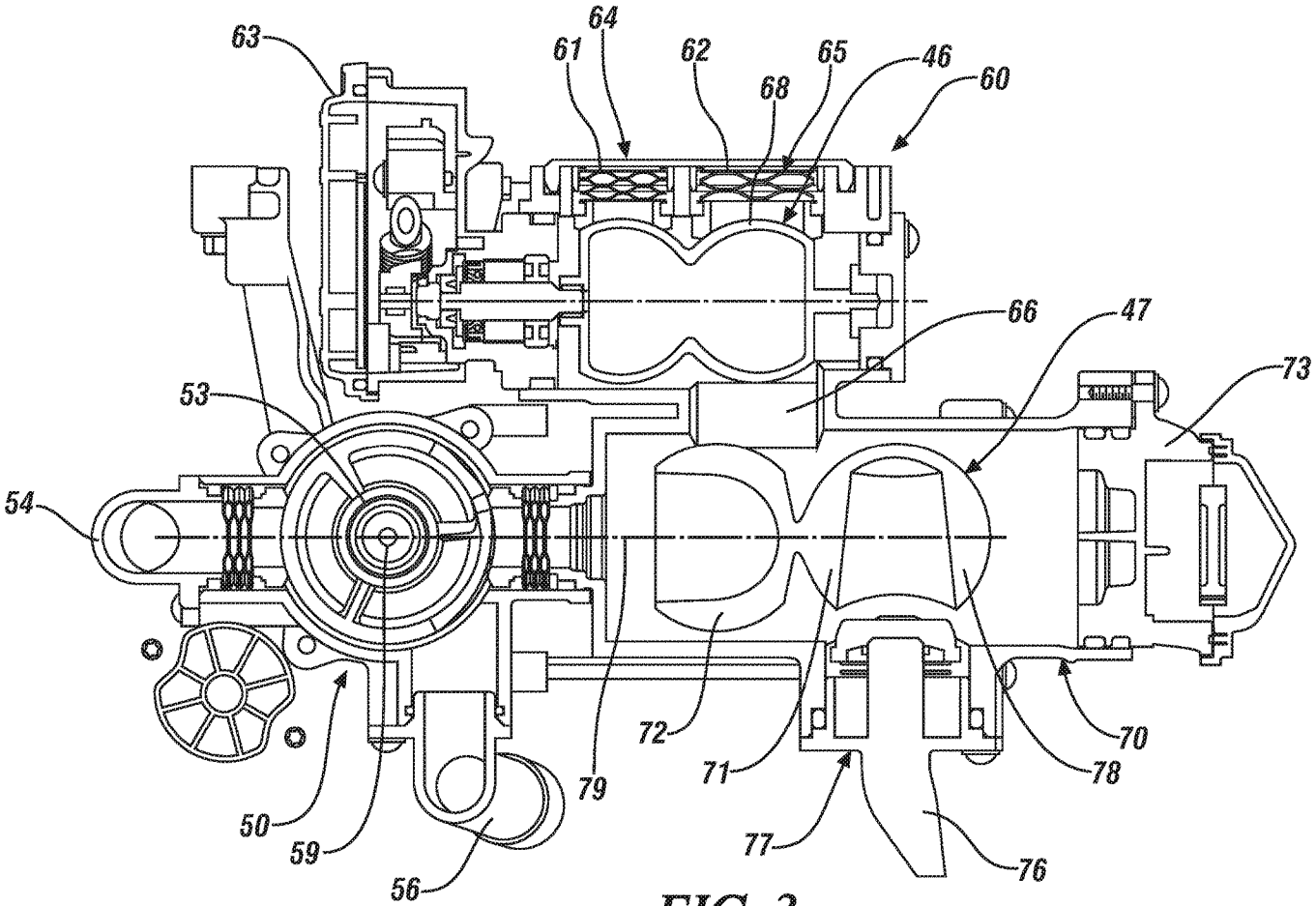
FIG. 3 is a sectioned top-view of an embodiment of a fluidic valve assembly of the thermal management system, in accordance with the disclosure.

FIG. 2 illustrates a sectioned right-side view of an embodiment of the fluidic valve assembly 40 of the thermal management system 20, and is described herein with reference to FIG. 3 and with continued reference to FIG. 1. The fluidic valve assembly 40 includes the first rotary valve 50, a second rotary valve 60 and a third rotary valve 70 that are disposed in a unitary housing 42. The fluidic valve assembly 40 can be assembled onto the engine block 12 at a convenient location. In terms of a direction of flow from the fluidic pump 30, the second rotary valve 60 is disposed upstream of the third rotary valve 70, which is upstream of the first rotary valve 50.

The unitary housing 42 is a single device that is configured with a first annular portion 45, a second annular portion 46 and a third annular portion 47. The unitary housing 42 can be assembled onto the engine block 12. Each of the first, second and third rotary valves 50, 60, and 70, respectively, includes a rotatable valve body that is disposed within the respective first, second and third annular portion 45, 46, and 47 and is coupled to a respective actuator. Other elements, e.g., fluidic seals, bearings, and the like can be included but not described.

The first rotary valve 50 includes a rotatable valve body 58 that includes a first disc-shaped valve element in the form of a transmission fluid valve 51 and a second disc-shaped valve element in the form of an engine oil valve 52. The rotatable valve body 58 including the transmission fluid valve 51 and the engine oil valve 52 are disposed within the first annular portion 45 of the unitary housing 42 associated with the first rotary valve 50. The transmission fluid valve 51 and the engine oil valve 52 of the first rotary valve 50 are configured to be coaxial about a first axis of rotation 59. A fluidic inlet 54 is fluidly coupled to the first annular portion 45 of the unitary housing 42 associated with the first rotary valve 50 via a conduit to the fluidic pump 30. A first fluidic outlet 55 is associated with the transmission fluid valve 51 and fluidly couples the first annular portion 45 of the unitary housing 42 to the transmission fluid heat exchanger 34. A second fluidic outlet 56 is associated with the engine oil valve 52 and fluidly couples the first annular portion 45 of the unitary housing 42 to the engine oil heat exchanger 36. The first rotary valve 50 is coupled to a first rotary actuator 53, which is operatively connected to the controller 15 such that the controller 15 can command a rotational position of the first rotary actuator 53, and thus control a rotational position of the rotatable valve body 58. Thus, the transmission fluid valve 51 is controllably disposed to regulate flow of coolant to the transmission fluid heat exchanger 34, and the engine oil valve 52 is controllably disposed to regulate flow of coolant to the engine oil heat exchanger 36. The first rotary actuator 53 can be configured to rotate the rotatable valve body 58 to control fluidic flow through the transmission fluid valve 51 and the engine oil valve 52 in concert in one embodiment. Alternatively, the first rotary actuator 53 can be configured to rotate the rotatable valve body 58 to control flow through the transmission fluid valve 51 independently from the flow through the engine oil valve 52.

The second rotary valve 60 includes a rotatable valve body 68 that includes a third disc-shaped valve element in the form of an engine block valve 61 and a fourth disc-shaped valve element in the form of a cylinder head valve 62. The rotatable valve body 68 including the engine block valve 61 and the cylinder head valve 62 are disposed within the second annular portion 46 of the unitary housing 42 associated with the second rotary valve 60. An engine block fluidic inlet 64 is fluidly coupled to the second annular portion 46 of the unitary housing 42 associated with the second rotary valve 60 via a conduit to the engine block valve 61, and a cylinder head inlet 65 is fluidly coupled via a conduit to the cylinder head valve 62. A fluidic outlet 66 fluidly couples the second annular portion 46 of the unitary housing 42 associated with the second rotary valve 60 to a first fluidic inlet 74 of the third rotary valve 70. A second fluidic outlet 66 is associated with the engine oil valve 52 and fluidly couples the second annular portion 46 of the unitary housing 42 associated with the second rotary valve 60 to the engine oil heat exchanger 36. The second rotary valve 60 is coupled to a second rotary actuator 63, which is operatively connected to the controller 15 such that the controller 15 can command a rotational position of the second rotary actuator 63, and thus control a rotational position of the second rotatable valve body 68. Thus, the engine block valve 61 is controllably disposed to regulate coolant flow from the fluid jacket 24 for the engine block 12, and the cylinder head valve 62 is controllably disposed to regulate coolant flow from the fluid jacket 26 for the cylinder head 14. The second rotary actuator 63 can be configured to rotate the rotatable valve body 68 to control flow through the engine block valve 61 and the cylinder head valve 62 in concert in one embodiment. Alternatively, the second rotary actuator 63 can be configured to rotate the rotatable valve body 68 to control flow through the engine block valve 61 independently from the flow through the cylinder head valve 62.

The third rotary valve 70 includes a rotatable valve body 78 that includes a fifth disc-shaped valve element in the form of a heater core valve 71 and a sixth disc-shaped valve element in the form of a radiator valve 72. The rotatable valve body 78 including the heater core valve 71 and the radiator valve 72 are disposed within the third annular portion 47 of the unitary housing 42 associated with the third rotary valve 70 and are configured to be coaxial about a second axis of rotation 79. The first fluidic inlet 74 is fluidly coupled to the third annular portion 47 of the unitary housing 42 via a conduit to the fluidic outlet 66 of the second rotary valve 60, and a second fluidic inlet 75 is fluidly coupled to the third annular portion 47 of the unitary housing 42 via a conduit to the exhaust manifold fluid jacket 28. A first fluidic outlet 76 fluidly couples the third annular portion 47 of the unitary housing 42 to the cabin heater core 32, and a second fluidic outlet 77 fluidly couples the third annular portion 47 of the unitary housing 42 to the radiator 38. The third rotary valve 70 is coupled to a third rotary actuator 73, which is operatively connected to the controller 15 such that the controller 15 can command a rotational position of the third rotary actuator 73, and thus control a rotational position of the third rotary valve body 78. Thus, the heater core valve 71 is controllably disposed to regulate coolant flow from the second rotary valve 60 and the fluid jacket 28 for the exhaust manifold 16 to the cabin heater core 32, and the radiator valve 72 is controllably disposed to regulate coolant flow from the second rotary valve 60 and the fluid jacket 28 for the exhaust manifold 16 to the radiator 38.

The third rotary actuator 73 can be configured to rotate the rotatable valve body 78 to control flow through the heater core valve 71 and the radiator valve 72 in concert in one embodiment. Alternatively, the third rotary actuator 73 can be configured to rotate the rotatable valve body 78 to control flow through the heater core valve 71 independently from the flow through the radiator valve 72.

Figure 4:
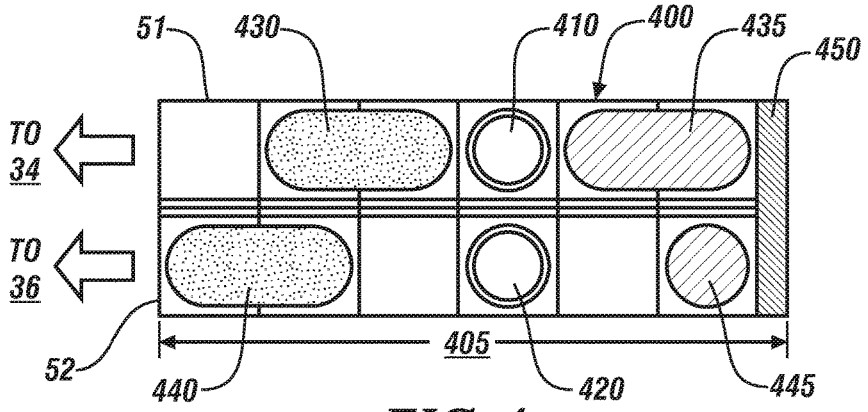
FIG. 4 is a linear representation of a side-view depicting a 360° rotation of a rotatable valve body of the first rotary valve depicting fluidic pathways therethrough, in accordance with the disclosure.
Figure 5:
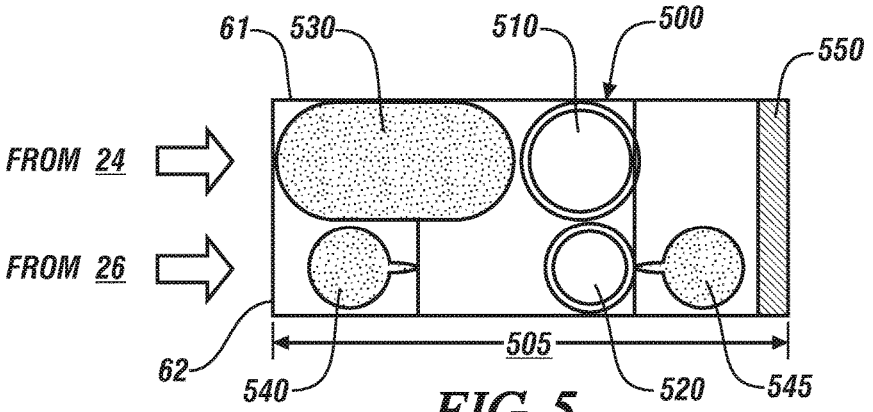
FIG. 5 is a linear representation of a side-view depicting a 360° rotation of a rotatable valve body of the second rotary valve depicting fluidic pathways therethrough, in accordance with the disclosure.
Figure 6:
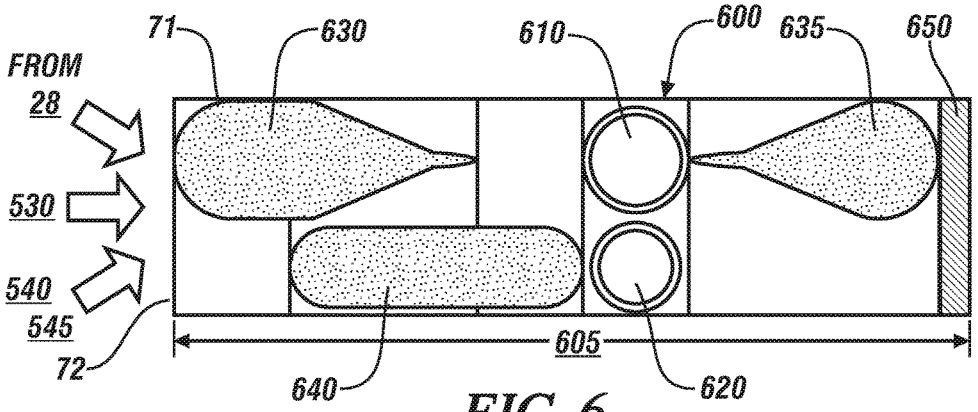
FIG. 6 is a linear representation of a side-view depicting a 360° rotation of a rotatable valve body of the third rotary valve depicting fluidic pathways therethrough, in accordance with the disclosure.

FIGS. 4, 5 and 6 are each described with continued reference to the embodiments described with reference to FIGS. 1, 2 and 3.

FIG. 4 is a linear representation 400 of a side-view depicting a 360° rotation of the rotatable valve body 58 of the first rotary valve 50, including the disc-shaped transmission fluid valve 51 that is disposed to regulate flow of coolant to the transmission fluid heat exchanger 34 and the disc-shaped engine oil valve 52 that is disposed to regulate flow of coolant to the engine oil heat exchanger 36. The horizontal axis 405 represents degrees of rotation, which can be 360° degrees of rotation or, alternatively, a portion of the 360° degrees of rotation. Fluidic inputs to the rotatable valve body 58 include a first input 430 to the transmission fluid valve 51, which supplies coolant that is output from the engine block fluid jacket 24, and a second input 435, which supplied coolant that is output directly from the pump 30. Fluidic inputs to the rotatable valve body 58 also include a first input 440 to the engine oil valve 52, which supplies coolant that is output from the engine block fluid jacket 24, and a second input 445, which supplied coolant that is output directly from the pump 30. Other elements include zero flow portions 410 and 420, and a diagnostic deadband portion 450. This configuration facilitates controlled flow of coolant to transfer heat to or heat away from the transmission fluid heat exchanger 34, depending upon the rotational position of the transmission fluid valve 51. This configuration facilitates controlled flow of coolant to transfer heat to or heat away from the engine oil heat exchanger 36, depending upon the rotational position of the transmission fluid valve 51.

FIG. 5 is a linear representation 500 of a side-view depicting a 360° rotation of the rotatable valve body 68 of the second rotary valve 60, including the disc-shaped engine block valve 61 that is disposed to regulate flow of coolant from the engine block fluid jacket 24 to a first input 530 to the third rotary valve 70, and the disc-shaped cylinder head valve 62 that is disposed to regulate flow of coolant from the cylinder head fluid jacket 26 to second and third inputs 540, 545, respectively, to the third rotary valve 70. The horizontal axis 505 represents degrees of rotation, which can be 360° degrees of rotation or, alternatively, a portion of the 360° degrees of rotation. Fluidic inputs to the rotatable valve body 68 include fluidic flow from the engine block fluid jacket 24 and the cylinder head fluid jacket 26. Other elements include zero flow portions 510 and 520, and a diagnostic deadband portion 550. This configuration facilitates regulated flow of coolant from the engine block fluid jacket 24 and the cylinder head fluid jacket 26.

FIG. 6 is a linear representation 600 of a side-view depicting a 360° rotation of the rotatable valve body 78 of the third rotary valve 70, including the disc-shaped heater core valve 71 that is disposed to regulate flow to the heater core 32 and the disc-shaped radiator valve 72 that is disposed to regulate flow to the radiator 38. The horizontal axis 605 represents degrees of rotation, which can be 360° degrees of rotation or, alternatively, a portion of the 360° degrees of rotation. Fluidic inputs to the rotatable valve body 78 include flow from the integrated exhaust manifold fluid jacket 28 and the regulated flow of coolant from the engine block fluid jacket 24 from the first input 530 to the third rotary valve 70, and the flow of coolant from the cylinder head fluid jacket 26 from the second and third inputs 540, 545, respectively, to the third rotary valve 70. Fluidic output from the heater core valve 71 include a first output 630 and a second output 635 to regulate flow to the heater core 32. Fluid output from the radiator valve 72 includes a first output 640 to regulate flow to the radiator 38. Other elements include zero flow portions 610 and 620, and a diagnostic deadband portion 650. This configuration facilitates controlled flow of coolant to transfer heat to the heater core 32 and the radiator 38.

The concepts described herein include embodiments of the fluidic valve assembly 40 of the thermal management system 20 that provide for a unitary device having multiple coolant flow control functions that fits within a compact packaging envelope by employing valve elements that have non-parallel axes of rotation. Packaging the valve elements with non-parallel axes of rotation can minimize length of the fluidic valve assembly 40 by orienting the various valve actuators associated with the various rotary valves in different planes. This arrangement also advantageously provides a reduced part count as compared to presently available flow control valve arrangements.

The detailed description and the drawings or figures are supportive and descriptive of the present teachings, but the scope of the present teachings is defined solely by the claims. While some of the best modes and other embodiments for carrying out the present teachings have been described in detail, various alternative designs and embodiments exist for practicing the present teachings defined in the appended claims.

What is claimed is:

1. A fluidic valve assembly disposed in a thermal management system for an internal combustion engine, comprising:

a unitary housing including a first rotary valve, a second rotary valve and a third rotary valve, wherein the first, second and third rotary valves include a respective first, second and third rotatable valve body that is coupled to a respective first, second and third actuator;

wherein the first, second and third rotary valves are disposed to regulate fluidic flow between heat exchange elements of the thermal management system;

wherein the second and third rotary valves are coaxially disposed about a first axis of rotation;

wherein the first rotary valve is coaxially disposed about a second axis of rotation; and wherein the first axis of rotation is non-parallel to the second axis of rotation.

2. The fluidic valve assembly of claim 1, wherein the first axis of rotation is orthogonal to the second axis of rotation.

3. The fluidic valve assembly of claim 1, wherein the thermal management system includes a fluidic circuit composed of a plurality of heat exchange elements and a fluidic pumping element.

4. The fluidic valve assembly of claim 1, wherein each of the rotatable valve bodies comprises a disc-shaped element that is disposed within a respective annular portion of the unitary housing.

5. A fluidic valve assembly configured to direct fluidic flow in a thermal management system of a powertrain system, wherein the thermal management system includes a fluidic circuit including a first heat exchange element, a second heat exchange element, a third heat exchange element, a fourth heat exchange element, a fifth heat exchange element, a sixth heat exchange element, a seventh heat exchange element and a fluidic pumping element, the fluidic valve assembly comprising:

a first rotary valve including a first rotatable valve body disposed within a first annular portion of a housing and coupled to a first actuator;

a second rotary valve including a second rotatable valve body disposed within a second annular portion of the housing and coupled to a second actuator;

a third rotary valve including a third rotatable valve body disposed within a third annular portion of the housing and coupled to a third actuator;

wherein the first rotatable valve body includes a first valve element controllably disposed to regulate coolant flow to the fifth heat exchange element, and a second valve element controllably disposed to regulate coolant flow to the sixth heat exchange element;

wherein the second rotatable valve body includes a third valve element controllably disposed to regulate coolant flow from the first heat exchange element, and a fourth valve element controllably disposed to regulate coolant flow from the second heat exchange element;

wherein the third rotatable valve body includes a fifth valve element controllably disposed to regulate coolant flow from the second rotary valve and the fourth heat exchange element to the third heat exchange element and a sixth valve element controllably disposed to regulate coolant flow from the second rotary valve and the fourth heat exchange element to the seventh heat exchange element;

wherein the first and second valve elements of the first rotary valve are coaxial about a first axis of rotation;

wherein the third and fourth valve elements of the second rotary valve are coaxial about a second axis of rotation; and wherein the first axis of rotation is non-parallel to the second axis of rotation.

6. The fluidic valve assembly of claim 5, wherein the first axis of rotation is orthogonal to the second axis of rotation.

7. A fluidic valve assembly configured to direct fluidic flow in a thermal management system of a powertrain system, wherein the thermal management system includes a fluidic circuit including a fluid jacket for an engine block, a fluid jacket for a cylinder head, a cabin heater core, a fluid jacket for an exhaust manifold, a transmission fluid heat exchanger, an engine oil heat exchanger, a radiator and a fluidic pumping element, the fluidic valve assembly comprising:

a first rotary valve, a second rotary valve and a third rotary valve disposed in a housing, wherein each of the first, second and third rotary valves includes a respective rotatable valve body disposed within a respective annular portion of the housing and coupled to an actuator;

wherein the rotatable valve body of the first rotary valve includes a first valve element controllably disposed to regulate coolant flow to the transmission fluid heat exchanger, and a second valve element controllably disposed to regulate coolant flow to the engine oil heat exchanger;

wherein the rotatable valve body of the second rotary valve includes a third valve element controllably disposed to regulate coolant flow from the fluid jacket for the engine block, and a fourth valve element controllably disposed to regulate coolant flow from the fluid jacket for the cylinder head;

wherein the rotatable valve body of the third rotary valve includes a fifth valve element controllably disposed to regulate coolant flow from the second rotary valve and the fluid jacket for the exhaust manifold to the cabin heater core and a sixth valve element controllably disposed to regulate coolant flow from the second rotary valve and the fluid jacket for the exhaust manifold to the radiator;

wherein the first and second valve elements of the first rotary valve are coaxial about a first axis of rotation;

wherein the third and fourth valve elements of the second rotary valve are coaxial about a second axis of rotation; and wherein the first axis of rotation is non-parallel to the second axis of rotation.

8. The fluidic valve assembly of claim 7, wherein the first axis of rotation is orthogonal to the second axis of rotation.

9. The fluidic valve assembly of claim 7, wherein the rotatable valve body of the first rotary valve including the first valve element is controllably disposed to regulate coolant flow from the fluid jacket for the engine block to the transmission fluid heat exchanger.

10. The fluidic valve assembly of claim 7, wherein the rotatable valve body of the first rotary valve including the first valve element is controllably disposed to regulate coolant flow from the fluid jacket for the engine block to the engine oil heat exchanger.

11. The fluidic valve assembly of claim 7, wherein the rotatable valve body of the first rotary valve including the first valve element is controllably disposed to regulate coolant flow from the radiator to the transmission fluid heat exchanger.

12. The fluidic valve assembly of claim 7, wherein the rotatable valve body of the first rotary valve including the first valve element is controllably disposed to regulate coolant flow from the radiator to the engine oil heat exchanger.

* * * * *